US006473106B2

(12) United States Patent
Fukasawa

(10) Patent No.: US 6,473,106 B2
(45) Date of Patent: Oct. 29, 2002

(54) LED HEAD, IMAGE FORMING APPARATUS, AND METHOD OF MEASURING AMOUNT OF LIGHT FROM LED ARRAY

(75) Inventor: Motomu Fukasawa, Iruma (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/725,817

(22) Filed: Nov. 30, 2000

(65) Prior Publication Data

US 2001/0013888 A1 Aug. 16, 2001

(30) Foreign Application Priority Data

Dec. 2, 1999 (JP) ..... 11-343588
Dec. 2, 1999 (JP) ..... 11-343589

(51) Int. Cl.[7] ..... B41J 2/385; G03G 13/04
(52) U.S. Cl. ..... 347/130
(58) Field of Search ..... 347/130, 133, 347/238, 236, 246

(56) References Cited

U.S. PATENT DOCUMENTS 5,774,165 A 6/1998 Nakajima et al.
5,801,404 A 9/1998 Kahen et al.
5,814,841 A 9/1998 Kusuda et al.
5,963,756 A * 10/1999 Sakai et al.
6,052,135 A * 4/2000 Ender et al.

FOREIGN PATENT DOCUMENTS

| | | |
|---|---|---|
| EP | 0 704 915 | 4/1996 |
| EP | 0 868 070 | 9/1998 |
| JP | 10-016291 | 1/1998 |
| JP | 10-185684 | 7/1998 |

* cited by examiner

*Primary Examiner*—Susan S. Y. Lee
(74) *Attorney, Agent, or Firm*—Fitzpatrick, Cella, Harper & Scinto

(57) ABSTRACT

An LED printer head capable of reducing influence of a sub emission band by use of a rod lens array and thus prevent light of the sub emission band from reaching a development level. The LED printer head consists of an LED array of LEDs to emit light according to an image signal, which are arrayed at the resolution pitch P of not less than 600 dpi, and a multi-lens array for forming an emission image of the LED array on a photosensitive body. Each of the LEDs of the LED array has a main emission band of an emission spectrum and another sub emission band having a peak level of not less than 0.01 as a photosensitive intensity ratio R to the main emission spectrum, and a difference D between best total conjugate lengths at peak wavelengths of the main and sub emission bands by the multi-lens array is at least 0.15. Optical adjustment of the LED array and the multi-lens array is effected so that light of the main emission band is focused in a predetermined imaging relation on the predetermined photosensitive body.

31 Claims, 6 Drawing Sheets

LED HEAD, IMAGE FORMING APPARATUS, AND METHOD OF MEASURING AMOUNT OF LIGHT FROM LED ARRAY

BACKGROUND OF THE INVENTION

1. Field of the Invention

The present invention relates to an LED head suitably applicable to the formation of an image in combination with the electrophotography and, more particularly, to an LED head with high resolving power and an image forming apparatus such as an LED printer or the like using the LED head. Further, the invention concerns a method of measuring an amount of light from the LED array, for measuring emission characteristics of the LED array used in LED heads and LED printers.

2. Related Background Art (Prior Art 1)

It is common practice heretofore to use the LED printers with relatively low resolution, e.g., 300 dpi in combination with a bright array of two lines of rod lenses having the nominal angular aperture of 20° and the nominal line size of 0.9 mm or 1.1 mm. Using this rod lens array, a photosensitive body is exposed to an emission pattern of LEDs whereby an electrostatic image is formed on the photosensitive body. This electrostatic image is developed with toner and this toner image is transferred onto transfer sheet and then fixed. After that, the transfer sheet is discharged out of the LED printer.

AlGaAs-base materials and the like are generally known as materials for the LEDs of radiative regions for use in combination with this rod lens array.

It is, however, a recent tendency that the resolving power required of the printers is the high resolving power of 600 to 1200 dpi. Under such circumstances, there is such an increasing common tendency that as to a rod lens array employed, a stack of two lines of rod lenses of high resolution type having the nominal angular aperture of 12° and the nominal line size of 0.6 mm is used in combination with the LED array.

On the other hand, however, the AlGaAs-base LEDs demonstrate the phenomenon that there often exists a subsidiary (sub) emission band: near 870 nm in addition to a principal (main) emission band near 780 nm, as shown in the spectrum of FIG. 3.

FIG. 3 is a diagram in which the axis of abscissa indicates the wavelength and the axis of ordinate the photosensitive intensity, i.e., how the photosensitive body used can be sensitive to each spectral region by emission intensity of the LEDs.

In the conventional printer heads of low resolution, the dot-to-dot pitch of the rod lens array was sufficiently larger than blur amounts, and thus interference rarely occurred between blurs of dots. Accordingly, the influence of emission of this sub emission band posed no serious problem.

In recent years, however, this sub emission band is coming to affect the image with increases in the resolving power of printers. It is thus extremely difficult to achieve high resolution and high image quality of the printer heads using the AlGaAs-base LED array exhibiting the sub emission band at random.

FIG. 4 shows the imaging relation of an LED radiative point 1 of LED chip 2 with the sub emission band, including LEDs arrayed at the pitch P, through the high-resolution rod lens array 3 of currently well-known type with the nominal angular aperture of 12° and with relatively suppressed chromatic aberration. This figure illustrates that the main emission band and the sub emission band demonstrate a small difference D in TC length between TCmain and TCsub, the F-number is also large, and thus the light of the sub emission band is not so blurred on the photosensitive body 4.

FIG. 5 schematically shows how the dots are resolved where wafers with different intensities of the sub emission band are adjacent to each other.

In FIG. 5, the upper part shows a state in which the luminance B of the sub emission band, which varies wafer by wafer across the chip boundary indicated by a dotted line at the center, is superimposed on the luminance A of the main emission band of the constant light intensity, and the middle part schematically shows how a spot image of each LED chip is formed. Consequently, FIG. 5 shows a case in which the sub emission band B affects the spot luminance distribution more on the right side than on the left side. Since the blur of the left sub emission band is small, the sub emission band appears as a light amount unevenness component randomly overlaid on a predetermined development level and thus developed spot sizes vary chip by chip, as seen in the lower part of FIG. 5. As a consequence, the density difference occurs in chip units and it appears as degradation of image quality. Particularly, in the case wherein a wafer chip with different sub emission band characteristics is inserted in a repair step of a chip after die bonding, there appear uneven stripes in the range of several millimeters in a halftone image. This was the drawback of degrading the image quality, particularly, in the case of pictorial imagery.

In addition, it is very difficult to manage the height of the peak of this sub emission band for every wafer in the fabrication process. Further, a method of managing each of these wavelength distributions and carrying out works of the die bonding of chips could greatly affect cost and was not so practical.

An object of the present invention is, therefore, to decrease the influence of the sub emission band, based on the construction of the rod lens array in the LED printer head, provide a configuration in which the light of the sub emission band does not reach the development level, and realize the high image quality.

(Prior Art 2)

In recent years, color office documents are rapidly increasing with spread of personal computers and along therewith the LED printers are drawing attention as printing heads for color printers capable of printing such color documents at high speed. With the conventional LED printers, however, the principal emphasis was on the quality of letters, but emphasis was not laid so much on pictures, halftone images, and so on. In addition, correction for light amounts was also in such a level that variation among chips was corrected by chip resistance.

Therefore, this coming era requires techniques of precisely controlling light amounts while precisely measuring variation of light amounts themselves associated with the imagery, in order to output pictorial color documents.

Meanwhile, for development of high speed printers, the AlGaAs-base materials and the like are generally known as materials for the LEDs enabling highly efficient emission.

The AlGaAs-base LEDs involve the phenomenon that the sub emission band B considered to originate in a GaAs substrate appears in addition to the main emission band A, as illustrated by the solid line in FIG. 10. The wavelength of the main emission band A is approximately 780 nm and the wavelength of the sub emission band B is approximately 870 nm.

It is also common practice to use a silicon PIN photodiode with spectral sensitivity characteristics as indicated by a chain line C in FIG. 10, as a sensor used in measurement of light amounts.

FIG. 11 shows a typical configuration example of a conventional LED-array light-amount measuring device.

This configuration is a typical configuration of measuring apparatus, which is commonly employed by many LED light-amount measuring devices, for example as described in applications filed by the inventor, or in other applications, for example, Japanese Patent Application Laid-Open No. 10-185684.

In FIG. 11, first, an emission signal enough for emission of a light amount to be measured is supplied from a driver 21 of an emission signal generator to the LED array 22 as an object to be measured, to make a predetermined LED emit light. The light emitted travels through an imaging lens 23 to reach a PIN photodiode 26 with the spectral sensitivity indicated by the chain line C of FIG. 10 and a sensor part 24 thereof provides an electric output signal proportional to the light amount. The analog signal of this electric output signal is converted to a digital signal by an A/D converter 25 and a processing system 27 thereafter performs an operation to determine whether the emission amount of the predetermined LED is normal or not.

However, recent research clarified that delicate variation occurred every process of wafer in the light amount of the aforementioned sub emission band B. Therefore, if LED chips cut out of different wafers are ranked by the above method and mounted on a single head, there will occur cases in which chips with different light amounts of the sub emission band B are mixed in the head.

In such cases, since the influence of the light amount of the sub emission band on the actual images was different from that of the main emission band in terms of contribution to sensitivity, there arose the problem that even if the light amounts were measured using the sensor with the spectral characteristics C of FIG. 10 and if ranking of average light amount of chip and correction for light amount of each bit were carried out based on the result of the measurement it was infeasible to match the light amounts with levels of actual images in the situation in which the chips with different sub emission bands were mixed.

An object of the present invention is, therefore, to provide a method of measuring an amount of light from the LED array in the light-amount measuring apparatus for measuring the amount of emission not only from the LED chips but also from the LED array, and to provide an LED printer head and an LED printer fabricated and placed based on the result of measurement by the measuring method.

SUMMARY OF THE INVENTION

For solving the problem of prior art 1 described above, a first aspect of the present invention is to fully blur the spot of the sub emission band varying wafer by wafer by making use of the magnitude of axial chromatic aberration between the peak wavelengths of the main emission band and the sub emission band, so as to prevent the light of the sub emission band from reaching the development level, thereby accomplishing the high image quality to the contrary.

The problem of prior art 2 described above was caused because the light amounts of the two emission bands with the different effects on the image were handled on an equal basis.

For solving this problem, a second aspect of the present invention is to interpose an optical element for separating the main emission band from the sub emission band, for example, an optical element with the spectral characteristics D as illustrated in FIG. 6, to separate this main emission band A from the sub emission band B, separately measure and evaluate them, perform an operation according to degrees of influence on the printer, and handle the data as light amount data, thereby enabling accurate correction for light amounts and accurate ranking of chips.

An LED head according to one aspect of the invention is an LED head comprising an LED array of LEDs which emit light according to an image signal and which are arrayed at a resolution pitch P of not less than 600 dpi, and a multi-lens array for forming an emission image of said LED array on an information medium, wherein each of the LEDs of the LED array has a main emission band being an emission spectrum for formation of a main image and a sub emission band apart from a peak wavelength of the emission spectrum of the main emission band, and wherein a difference D between best TCs at peak wavelengths of the emission spectrum of the main emission band and an emission spectrum of the sub emission band by the multi-lens array is at least 0.15 mm, and optical adjustment of the LED array and the multi-lens array is implemented so that light of the main emission band is focused in a predetermined imaging relation on the predetermined information medium.

In the LED head according to another aspect of the invention, said information medium is a photosensitive body, the peak wavelength of the main emission band and the peak wavelength of the sub emission band are 50 nm or more apart from each other, and a photosensitive intensity ratio R of the sub emission band to the main emission band in the photosensitive body is not less than 0.01.

In the LED head according to another aspect of the invention, an imaging element satisfying the following relation is used:

$$(2PF/D)^2 * R < 0.01,$$

where F is an equivalent F-number of said multi-lens array.

In the LED head according to another aspect of the invention, the LED array is AlGaAs-base LED chips.

In the LED head according to another aspect of the invention, the main emission band has a peak in the range of 700 nm to 800 nm and the sub emission band has a peak in the range of 850 nm to 900 nm.

In the LED head according to another aspect of the invention, the multi-lens array is an array of two lines of graded index type glass rod lenses with a nominal angular aperture of 20° and a nominal rod size of 0.6 mm in trefoil formation.

An image forming apparatus according to a further aspect of the invention is an image forming apparatus comprising the LED array as set forth in either one of the above LED heads, wherein the information medium is a photosensitive body, the image forming apparatus comprising a developing unit for attaching toner to the photosensitive body to form a toner image thereon, a transfer charger for transferring the toner image formed on the photosensitive body, onto a transfer medium, and a fixing unit for fixing the transferred toner image on the transfer medium.

An image forming apparatus according to a further aspect of the invention is an image forming apparatus comprising the LED array as set forth in either one of the above LED heads, wherein the information medium is a photosensitive body, and the image forming apparatus comprising a printer controller for converting code data supplied from an external device, into an image signal and supplying the image signal to the LED array.

An LED-array light-amount measuring method according to one aspect of the present invention is a method of measuring an amount of light from an LED array, wherein there are provided an LED array of LEDs for an LED head and a sensor portion for receiving an amount of light emitted from an activated LED and generating an electric output corresponding to the amount of light received, wherein the LED array of a measured object has a main emission band being an emission spectrum for formation of an image and a sub emission band being another emission spectrum apart from a peak wavelength of the emission spectrum of the main emission band, wherein spectral sensitivity of the sensor portion has approximately flat characteristics to the main emission band and the sub emission band, wherein an optical element for guiding the light amount of the main emission band with higher efficiency than the light amount of the sub emission band in accordance with sensitivity characteristics of a photosensitive body used with the LEDs is placed between the LED array and the sensor portion and emission characteristics of the LED array are measured.

In the method according to another aspect of the invention, the LED array has the main emission band of the emission spectrum for formation of an image and the sub emission band of another emission spectrum 50 nm or more apart from the peak wavelength of the main emission spectrum and a peak light amount of the sub emission band is 3% or more of a peak light amount of the main emission band.

An LED head according to a further aspect of the invention is an LED head wherein ranking or correction for light amount is effected according to data of measurement of light-amount unevenness of the LED array measured by the method described above.

Another LED-array light-amount measuring method according to a further aspect of the invention is a method of measuring an amount of light from an LED array, wherein there are provided an LED array of LEDs for an LED head and two sensor portions for receiving an amount of light emitted from an activated LED and generating an electric output corresponding to the amount of light received, wherein the LED array of a measured object has a main emission band being an emission spectrum for formation of image and a sub emission band being another emission spectrum apart from a peak wavelength of the emission spectrum of the main emission band, wherein spectral sensitivity of the sensor portions has approximately flat characteristics for the main emission band and said sub emission band, wherein an optical element for reflecting or transmitting a light amount of the main emission band and for transmitting or reflecting a light amount of the sub emission band is placed between the LED array and the two sensor portions, wherein the light amount of the main emission band is measured by one sensor portion out of the two sensor portions and the light amount of the sub emission band by the other sensor portion, a predetermined operation is carried out over measurement data of the light amount of the main emission band and measurement data of the light amount of the sub emission band to obtain single light-amount measurement data, and emission characteristics of the LED array are measured.

In the method according to another aspect of the invention, the LED array has the main emission band of the emission spectrum for formation of image and the sub emission band of another emission spectrum 50 nm or more apart from the peak wavelength of the main emission spectrum and a peak light amount of the sub emission band is 3% or more of a peak light amount of the main emission band.

In the method according to another aspect of the invention, the predetermined operation is an operation to determine a rate of influence from the main emission band and from the sub emission band according to the sensitivity characteristics of the photosensitive body on which an image is formed according to amounts of light emitted from the LED array and to combine measurement data of the light amount of the main emission band and the light amount of the sub emission band.

Another LED head according to a further aspect of the invention is an LED head wherein ranking or correction for light amount is effected according to data of measurement of light-amount unevenness of the LED array measured by the method described above.

Another LED-array light-amount measuring method according to a further aspect of the invention is a method of measuring an amount of light from an LED array, wherein there are provided an LED array of LEDs for an LED head and a sensor portion for receiving an amount of light emitted from an activated LED and generating an electric output corresponding to the amount of light received, wherein the LED array of a measured object has a main emission band being an emission spectrum for formation of image and a sub emission band being another emission spectrum apart from a peak wavelength of the emission spectrum of the main emission band, wherein spectral sensitivity of the sensor portion has approximately flat characteristics to the main emission band and the sub emission band, wherein an optical element for cutting either a light amount of the sub emission band or a light amount of the main emission band is placed in a retractable state between the LED array and the sensor portion, a predetermined operation is carried out over two output signal values obtained from two states of presence and absence of the optical element from the sensor portion, and emission characteristics of the LED array are measured.

In the method according to another aspect of the invention, the LED array has the main emission band of the emission spectrum for formation of an image and the sub emission band of another emission spectrum 50 nm or more apart from the peak wavelength of the main emission spectrum and a peak light amount of the sub emission band is 3% or more of a peak light amount of the main emission band.

In the method according to another aspect of the invention, the predetermined operation is an operation to determine a rate of influence from the main emission band and from the sub emission band according to the sensitivity characteristics of the photosensitive body on which an image is formed according to amounts of light emitted from the LED array and to combine measurement data of the light amount of the main emission band and the light amount of the sub emission band.

Another LED head according to a further aspect of the invention is an LED head wherein ranking or correction for light amount is effected according to data of measurement of light-amount unevenness of the LED array measured by the method described above.

In the method according to another aspect of the invention, the LED array is AlGaAs-base LED chips.

In the method according to another aspect of the invention, the main emission band has a peak in the range of 600 nm to 800 nm and the sub emission band has a peak in the range of 850 nm to 900 nm.

In the method according to another aspect of the invention, the sensor portion with the flat characteristics is a silicon PIN photodiode.

In the method according to another aspect of the invention, the optical element is a dichroic filter or mirror formed by stacking dielectric films and a medial wavelength of the dichroic filter or mirror is set between the peak wavelength of the main emission band and the peak wavelength of the sub emission band.

In the method according to still another aspect of the invention, the optical element is an absorbing filter having a higher absorption property of the sub emission band than that of said main emission band and a rate of transmittance of the main emission band and transmittance of the sub emission band is approximately equal to a rate of influence on the photosensitive body on which an image is formed according to amounts of light emitted from said LED array, from the light amount of the main emission band and from the light amount of the sub emission band.

In the method according to another aspect of the invention, the absorbing filter is a heat absorbing filter with different absorptances in the main emission band and in the sub emission band and a rate of transmittance of the main emission band and transmittance of the sub emission band is optimized by controlling a thickness of the heat absorbing filter.

Another image forming apparatus according to a further aspect of the invention is an image forming apparatus comprising the LED head as set forth, a photosensitive body, a developing unit for attaching toner onto the photosensitive body to form a toner image thereon, a transfer charger for transferring the toner image formed on the photosensitive body, onto a transfer medium, and a fixing unit for fixing the transferred toner image on the transfer medium.

Another image forming apparatus according to a further aspect of the invention is an image forming apparatus comprising the LED head as set forth, and a controller for converting code data supplied from an external device, into an image signal and supplying the image signal to the LED array.

DETAILED DESCRIPTION OF THE PREFERRED EMBODIMENTS

Embodiment A of the Invention

Embodiment A according to the present invention will be described in detail with reference to the drawings.

(First Embodiment)

Figure 1:
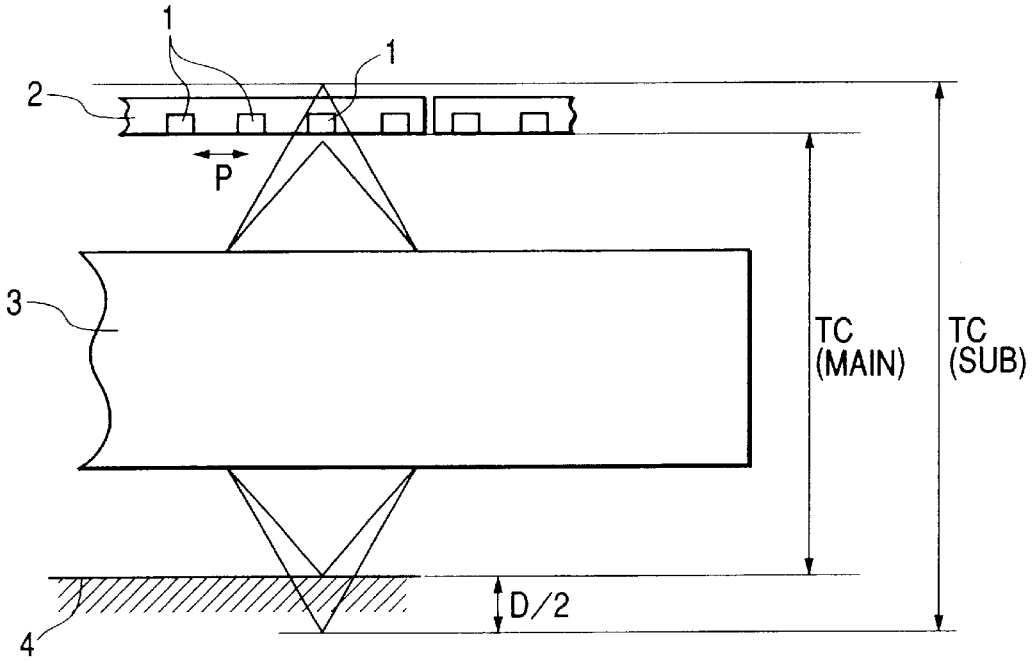
FIG. 1 is an explanatory diagram to illustrate the first embodiment of the present invention.

FIG. 1 is a cross-sectional view for explaining an embodiment of the present invention. In FIG. 1, reference numeral 1 designates radiative points of LEDs, 2 LED chips, 3 imaging means, and 4 a photosensitive body. A plurality of such LED chips 2 are arranged in tandem to form an LED array for an LED head. The imaging means 3 is an erecting 1:1 lens system consisting of an array of ion-exchanged rod lenses, which forms an emission pattern of the LED radiative points 1 on the photosensitive body 4, thereby exposing the photosensitive body 4 to light according to an image signal.

The photosensitive body 4 is scanned by rotation or the like in the vertical direction, i.e., in the sub-scanning direction relative to the array direction of LEDs, thereby forming a latent image of two-dimensional image information. In this case, as illustrated in FIG. 1, the radiative points of the LED chip 2 and the photosensitive body 4 are located in the conjugate relation on the basis of the wavelength of the main emission band and the distance between them is illustrated as TCmain. In this case, the best conjugate relation of the sub emission band of the different wavelength is illustrated as TCsub. The difference between TCsub of the sub emission band and TCmain of the main emission band is illustrated as D.

For the printer head of the high resolution type of not less than 600 dpi in the LED array, the imaging element as the imaging means 3 is a high-resolution rod lens array of the type having the line size of 0.6 mm, large chromatic aberration, and the nominal angular aperture of 20°, and the photosensitive body 4 is illuminated according to the emission pattern.

The radiative points 1 of the LED chips are arrayed at the pitch P in the LED, array and exhibit the sub emission band in addition to the main emission band.

In this case, the difference D in TC length is large between the main emission band and the sub emission band and the F-number is small because of the large angular aperture. Therefore, when the main emission band is located in the best TC length relation, the light of the sub emission band is heavily blurred on the photosensitive body, which is schematically shown in the drawing.

Figure 2:
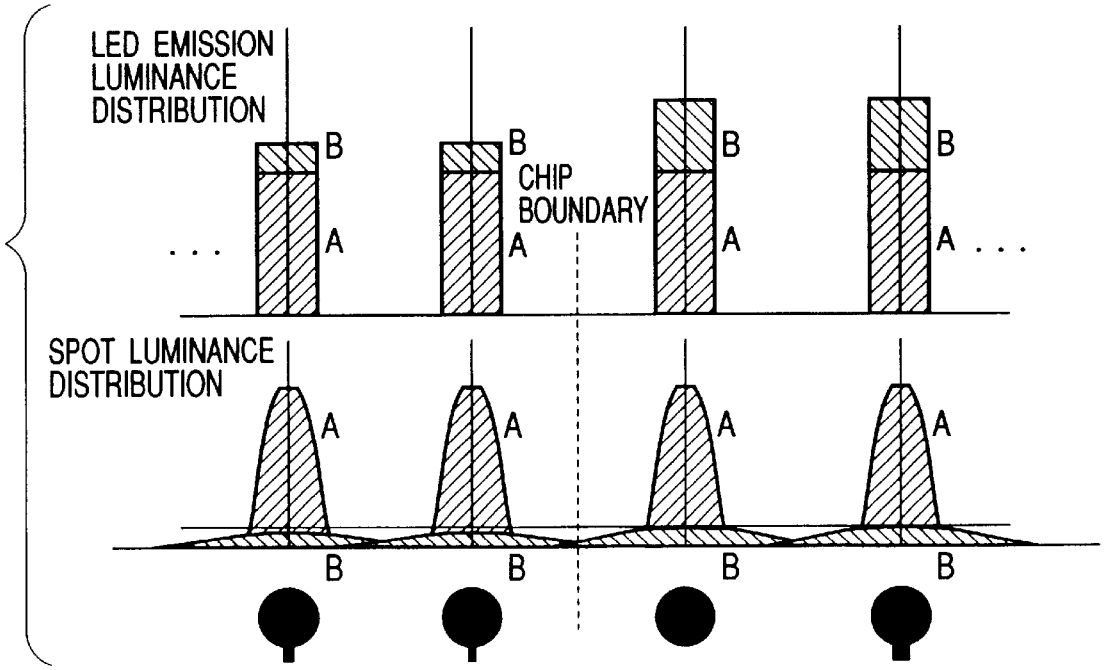
FIG. 2 is a diagram to illustrate the principle of the first embodiment of the present invention.
Figure 3:
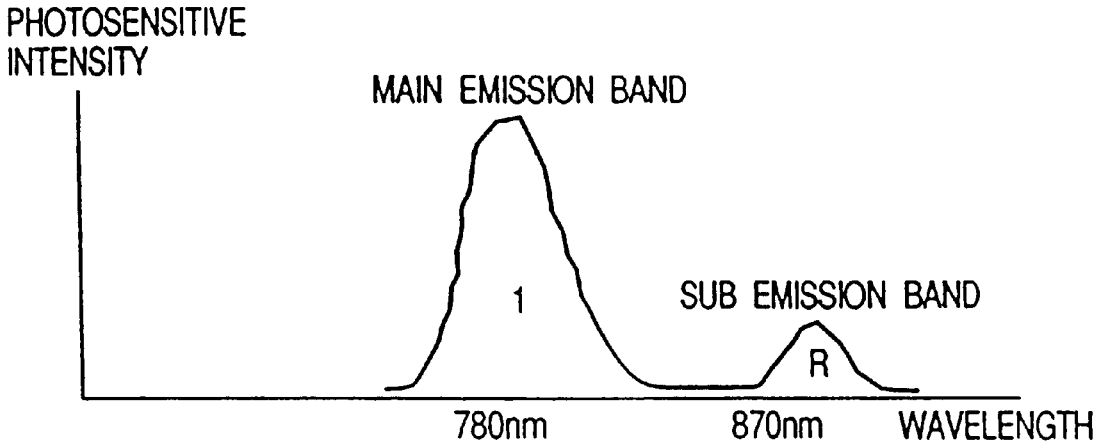
FIG. 3 is an explanatory diagram to illustrate the main emission band and the sub emission band of LED.
Figure 4:
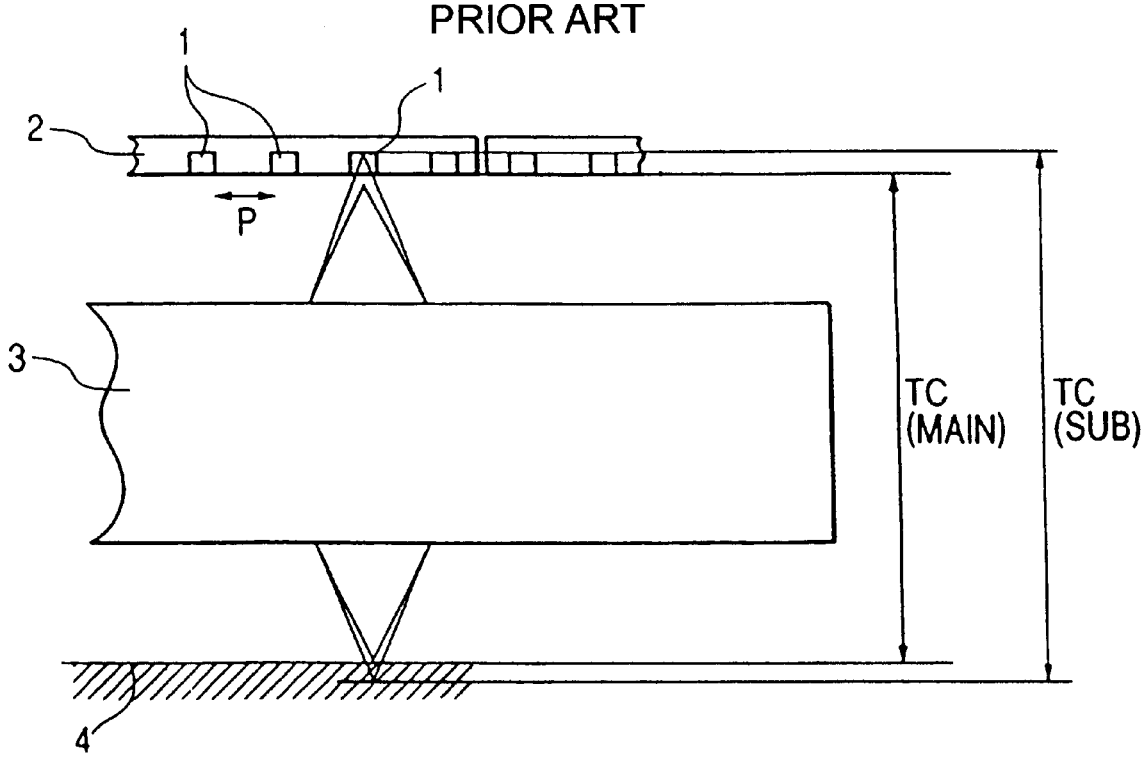
FIG. 4 PRIOR ART
FIG. 4 is an explanatory diagram to illustrate an LED printer of the conventional type.
Figure 5:
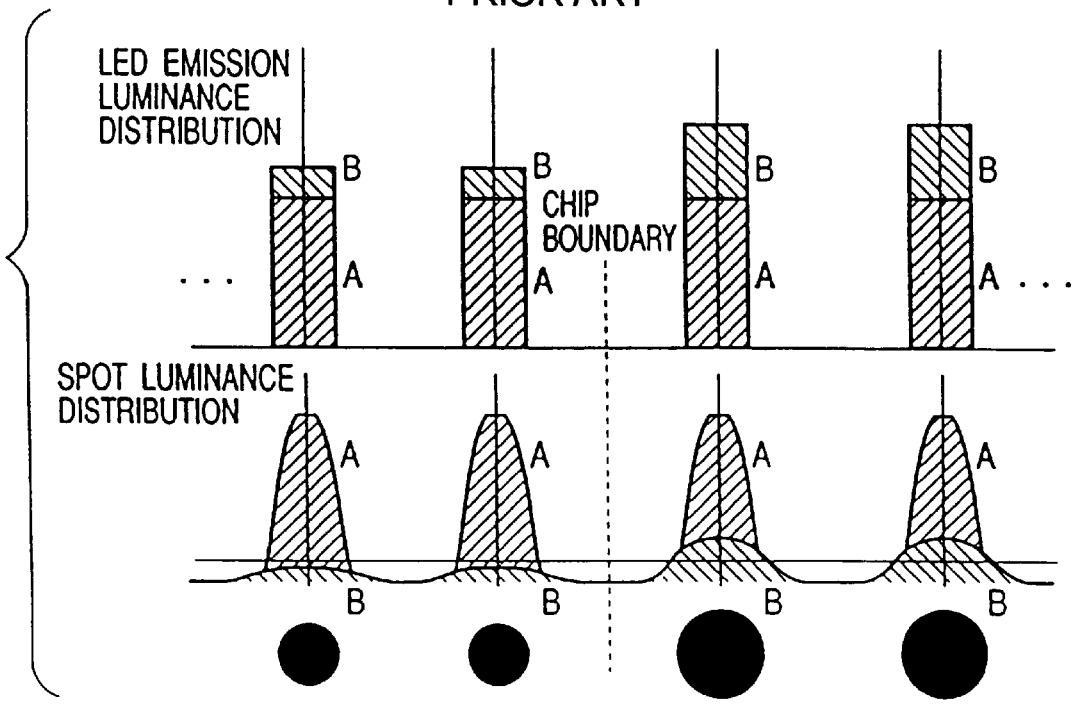
FIG. 5 PRIOR ART
FIG. 5 is an explanatory diagram to illustrate the problem in the prior art.

FIG. 2 schematically shows how the dots are developed where wafers with different intensities of the sub emission band are adjacent to each other.

The upper part of FIG. 2 shows a state in which the luminance B of the sub emission band, which varies between wafers across the chip boundary, is superimposed on the luminance A of the main emission band of constant light intensity, and the middle part schematically shows how spot images of the respective LED chips are formed. Consequently, since the blur of the sub emission band is large, the spot of the sub emission band cannot be a large offset component over the light amount spot of the main emission band when the random light amounts are superimposed on the predetermined development level. As a result, the sub emission band does not influence:the variation in light amounts much over the slice level during development. Thus variation in the developed spot sizes is hardly dependent upon the intensity of the sub emission band, as shown in the lower part of FIG. 2. For this reason, even if there are chips with different sub emission bands adjacent to each other, there will rarely occur density difference across the boundary, thereby making it feasible to achieve uniform and high image quality.

Specifically, the AlGaAs-base LEDs are used in combination with the rod lens array having the nominal angular aperture of 20° and the line size of 0.6 mm. For the AlGaAs-base LEDs, the peak wavelength of the main emission band is set at 780 nm by controlling a doping amount of Al. The LEDs themselves possess the sub emission band at the peak wavelength near 890 nm because of emission of the GaAs substrate.

The rod lens array with the nominal angular aperture of 20° and the line size of 0.6 mm is an erecting 1:1 means having the equivalent F-number of 1.1, which demonstrates large chromatic aberration and the value of 0.34 mm as the difference D between TCmain and TCsub.

A total spectral sensitivity intensity ratio R of the photosensitive body 4, which is obtained by multiplying a separation sensitivity ratio of the photosensitive body 4 in the main emission band and in the sub emission band, for example, an OPC drum with the ratio of 0.33, by the spectral emission intensity ratio of 0.30 of the LEDs 1, is about 0.1.

In the present embodiment, the effect was verified using a model wherein the equivalent F-number was 1.1, the LED pitch P=0.0423 mm (600 dpi), the difference D in the best TC length between the peak 780 nm of the main emission band and the peak 890 nm of the sub emission band was 0.34 mm, and the sensitivity ratio of the photosensitive body used to the main emission and the sub emission, i.e., the ratio R of spectral sensitivity and emission: intensity, R=0.1.

$$(2PF/D)^2*R=0.0075<0.01$$

For example, $(2\times0.0423\times1.1/0.34)^2\times0.1=0.0075$, and this value is not more than 0.01.

When the rod lens array is used in combination of the plural LEDs under the condition that the above equation holds, the LED array can be regarded as one that is little affected by the sub emission band.

Specifically, for example, the AlGaAs-base LEDs are advantageous in achievement of high resolution and high speed because of large light amounts and the effect of the present invention can be exhibited by the combination of the AlGaAs-base LEDs with the rod lens array having the nominal angular aperture of 20° and the line size of 0.6 mm (to blur the light of the sub emission band by chromatic aberration).

A printer can be constructed using the LED printer head of the present embodiment and an electrostatic image is formed on the photosensitive body by exposing the photosensitive body 4 to the emission pattern of LEDs through this rod lens array 3. This electrostatic image is developed with toner and this toner image is transferred onto a transfer sheet to be fixed thereon. Then the transfer sheet can be discharged out of the LED printer.

(Second Embodiment)

The second embodiment of the present invention will be presented to explain a case in which the peak wavelength of the main emission is a shorter wavelength.

The shorter wavelength of the main emission peak is the main emission peak wavelength of 740 nm to relatively increase the ratio of light amounts of the main emission and sub emission. Even if the sensitivity ratio is as large as about R=0.15, the value of the difference D between TCmain and TCsub increases to 0.50 because of the increase of wavelength difference, and the above equation becomes as follows.

$$(2PF/D)^2*R=0.0045<0.01$$

Therefore, the high quality state can be maintained without any problem.

Even if the LED emission pattern includes the sub emission band in addition to the main emission band, the LED printer equipped with this LED printer head can maintain the value proportional to the sensitivity level per unit blur amount even with variation in the sub emission band among the LEDs in the LED array, by use of the combination of the rod lens array with the LED array according to the present embodiment. This weakens the influence of the sub emission band, thereby preventing the light of the sub emission band from reaching the development level and thus achieving the high quality anyway.

As described above, the present invention provides the effect of realizing the LED printer with high resolution and high image quality while absorbing the intensity variation of the sub emission band among wafers, by sufficiently defocusing the light of the sub emission band to the level where the development is not affected, with making use of the axial chromatic aberration of the imaging means.

Embodiment B of the Invention

Embodiment B according to the present invention will be described below in detail with reference to the drawings.

(Third Embodiment)

Figure 6:
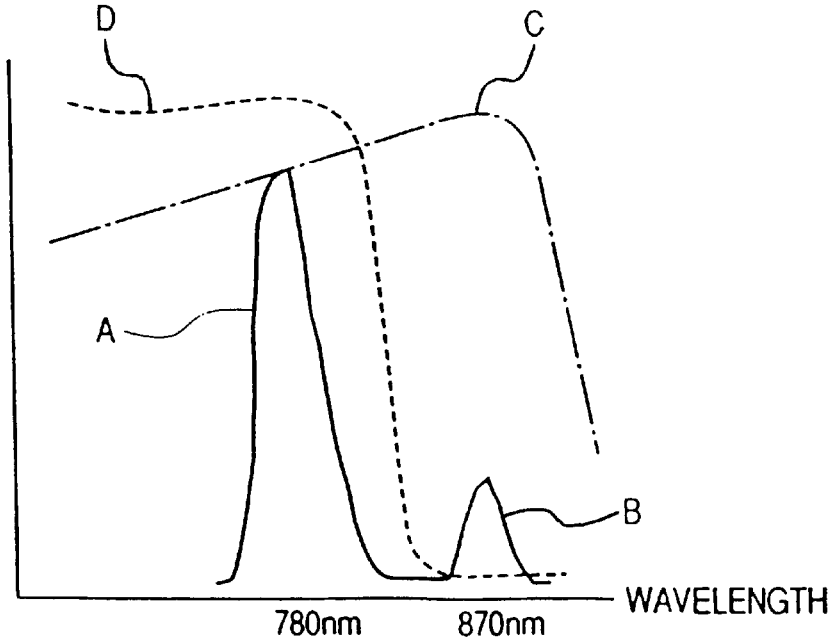
FIG. 6 is an explanatory diagram to illustrate the characteristics of the LED array and the filter characteristics as the principle of the present invention.
Figure 7:
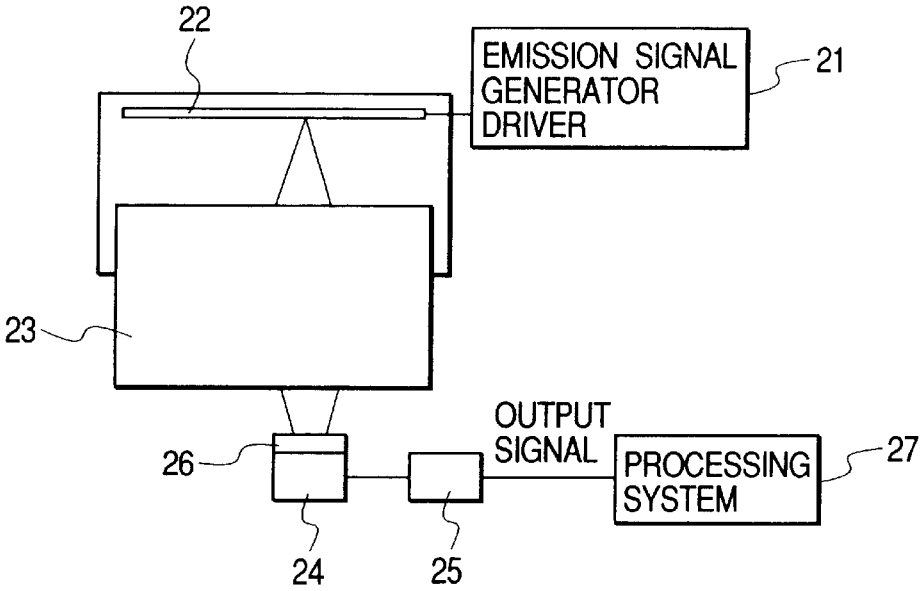
FIG. 7 is a block diagram to illustrate a measuring method in the third embodiment of the present invention.
Figure 11:
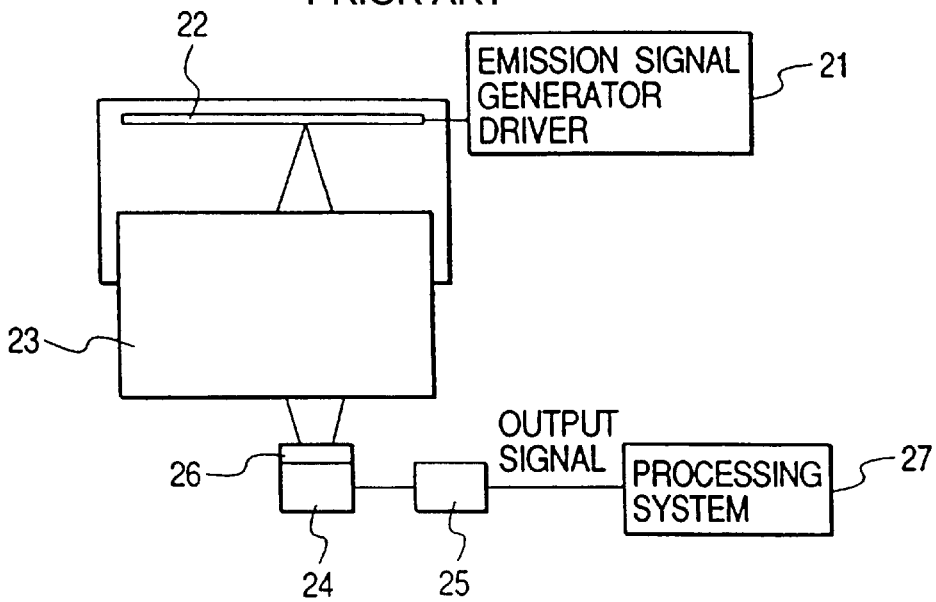
FIG. 11 PRIOR ART
FIG. 11 is a block diagram to illustrate the structure of the LED-array light-amount measuring device of the prior art example.

FIG. 7 shows a printer fabricated by providing the conventional system of FIG. 11 with an optical element 26 which is the feature of the present invention. The optical element 26 demonstrates the spectral transmittance as defined by the dashed line D of FIG. 6 and has such characteristics as to transmit only the light amount component of the main emission band A but cut the light amount of the sub emission band B.

Such an optical element is an interference filter readily fabricated by alternately stacking thin films of a dielectric with a high refractive index and a dielectric with a low refractive index and is also known as a dichroic filter because it demonstrates dichroism in the visible range.

In FIG. 7, first, such an emission signal as to an amount of light to be measured is supplied from the driver 21 of emission signal generator to the LED array 22 being an object to be measured, to make a predetermined LED emit light. The light emitted travels through the imaging lens 23 to reach the optical element 26 of a PIN photodiode with the spectral sensitivity indicated by the dashed line D in FIG. 6 and the sensor part 24 thereof obtains an electric output signal proportional to the amount of light. The analog signal of this electric output signal is converted to a digital signal by the A/D converter 25 and the signal processing system 27 thereafter performs an operation with the emission signal from the driver 21 to determine whether the amount of emission from the predetermined LED is normal or not. The characteristics of all the light emitting devices in the LED array are successively measured to determine whether the LED array is good or not.

In FIG. 7, the rod lens array is used as the imaging system 23 as it is, and the amounts of light are measured in the form of the LED printer head. Therefore, the LED printer head can serve as an LED printer head when the photosensitive body is disposed at the position of the optical element 26 in use of the LED array 22 and the imaging lens 23 illustrated in FIG. 7 and when the LED array 22 is actuated by the driver 21 driven by an image signal. Namely, the LED printer head is constructed in the same form as the measuring system. The LED printer is formed by providing the LED printer head with the photosensitive member, developing the image signal on the photosensitive member with toner, and transferring and fixing the toner image on a transfer sheet.

The present embodiment is also very effective for cases wherein the sub emission band B does not affect the LED printers used, for example, for the image forming apparatus having the element for cutting the sub emission band on the main body side, and for the LED printer heads in which the light of the sub emission band B is blurred by the imaging element with large chromatic aberration.

The LED array of the measured object has the main emission band of an emission spectrum for formation of image and the sub emission band of another emission spectrum 50 nm or more apart from the peak wavelength of the main emission spectrum, as illustrated in FIG. 6, and the peak light amount of the sub emission band B is 3% or more of the peak light amount of the main emission band A.

When the spectral sensitivity of the sensor part 24 has approximately flat characteristics to the main emission band A and the sub emission band B, the optical element to guide the light amount of the main emission band A with high efficiency but cut the light amount of the sub emission band B is interposed between the LED array 22 and the sensor part 24.

When a system is not provided with any means to weaken the influence of the sub emission band B, for example, when an object to be measured is an LED head employing an imaging element with small chromatic aberration, it is more preferable to employ such an element as to transmit the light while matching the degree of the influence with the rate of influence, as the optical element 26.

An average current value to the chips is modified so as not to make a difference in light amount among the chips, according to ranks of average light amounts of the respective chips obtained from the measurement data of the LED array 22. More specifically, light amount levels of the photoreceptive element 26 are averaged by selecting such a chip resistance as to increase the current value for chips with a small light amount but decrease the current value for chips with a large light amount. The correction for light amount unevenness among the chips can be implemented in such a manner that the period of emission time is controlled element by element so as to make exposure amounts constant.

Namely, the radiative points with different emission efficiencies even at a constant current value are controlled in the period of emission time so that the exposure amounts are of an average level, i.e., so that (emission amount per unit time×emission time) is constant, whereby the LED printer can be realized with reduced light-amount unevenness and with high quality.

Specifically, it is preferable to use a heat-absorbing filter with different absorptances in the main emission band and in the sub emission band while optimizing its thickness.

(Fourth Embodiment)

The present embodiment will be described as an example to explain how to use the LED printer head wherein the LED array measured by the LED printer measuring method in the third embodiment is provided with general versatility.

For commercial sale to the outside in the form of the printer head, different from in-house manufacturing, the sensitivity difference to the main emission band and the sub emission band, the exposure and development conditions, etc. vary depending upon photosensitive bodies used among LED printer makers of users. Therefore, the measuring system illustrated in FIG. 8 is constructed for providing the measuring system with general versatility.

Figure 8:
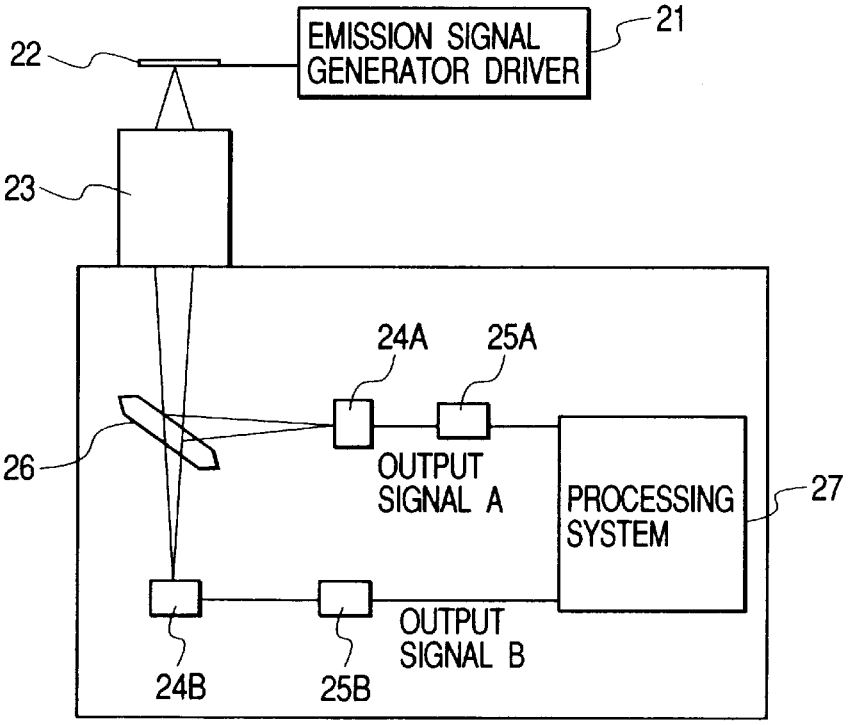
FIG. 8 is a block diagram to illustrate a measuring method in the fourth embodiment of the present invention.

With this system, as illustrated in FIG. 8, a predetermined emission signal is supplied from the driver 21 to the LED array 22 to activate the LED array 22, the light emitted therefrom is guided through an objective lens 23 and is separated midway into the main emission band A and the sub emission band B by the optical element 26 with the optical reflectance indicated by the dashed line D of FIG. 6, the beams of the respective bands are received by separate sensors 24A and 24B to be converted to output signals separately by respective A/D converters 25A, 25B, and the processing system 27 performs an operation to convert them to light amount data to be corrected, by adding them in a predetermined ratio according to the purpose of use, i.e., according to the sensitivity characteristics of the photosensitive body. This process can also be performed on an analog circuit if the predetermined ratio of the main emission band A and the sub emission band B is known.

Specifically, the effect on the image may also be determined by experiment or by computation, but, for example, where the main emission band: the sub emission band=8:2 in the emission spectrum of the LED array and where the photoreceptive characteristics of the corresponding photosensitive body are constant throughout the entire band, we can employ such LED arrays that the light amount data has values proportional to the following:

$$0.8\times(\text{output of sensor 4B})+0.2\times(\text{output of sensor 4A}).$$

Described in the third embodiment was the case wherein the dashed line D of FIG. 6 was the spectral transmittance data of the main emission band A of the optical element, but it is also possible to implement the processing similar to that described above, to obtain an image with high quality according to the image signal by matching the optical characteristics of the LED array used in the LED printer head with the characteristics of the photosensitive body of the LED printer and with the characteristics of the transfer sheet and toner transferred from the photosensitive member.

(Fifth Embodiment)

Figure 9:
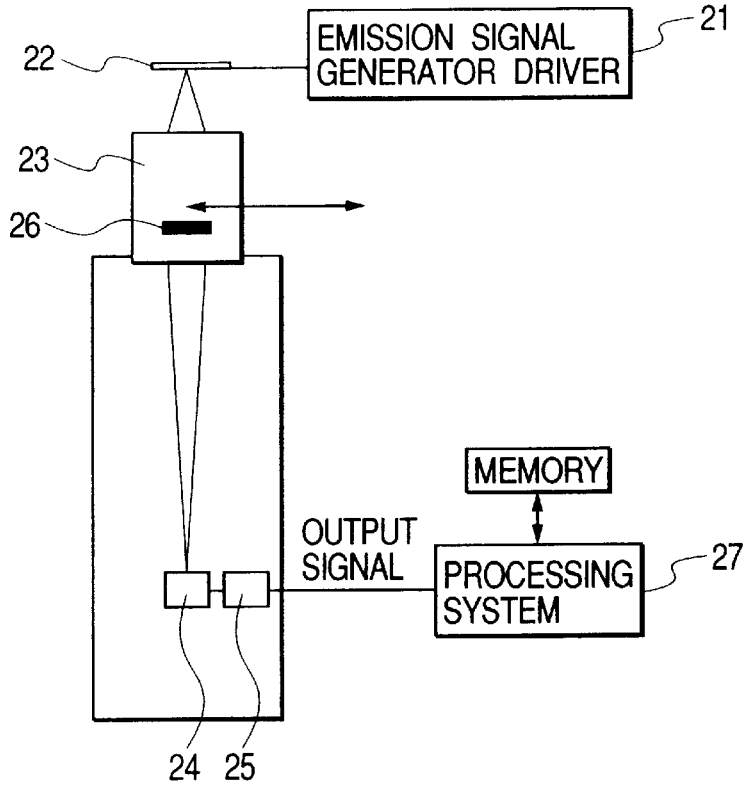
FIG. 9 is a block diagram to illustrate a measuring method in the fifth embodiment of the present invention.
Figure 10:
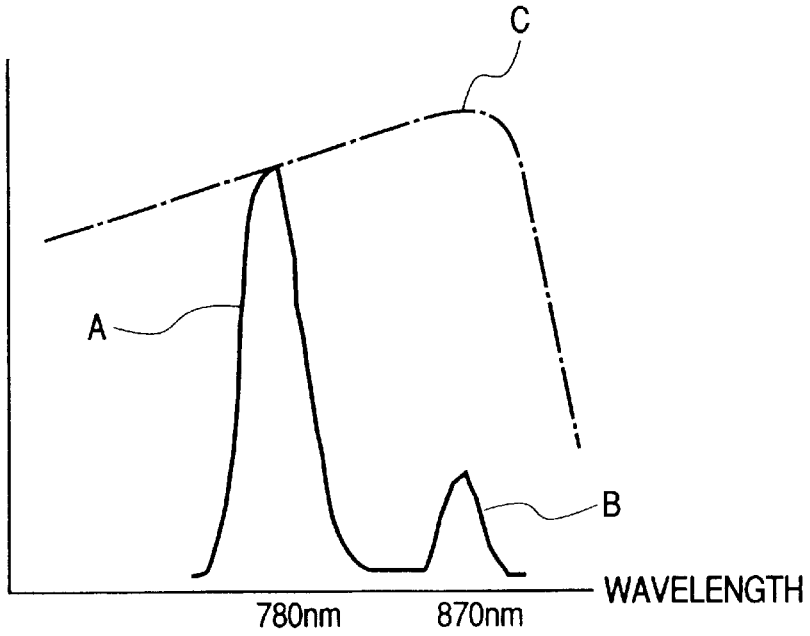
FIG. 10 is a characteristic diagram to illustrate the characteristics of the light emitting devices of the LED array, which illustrates the problem in the prior art.

FIG. 9 is a block diagram of a measuring system in which the LED array 22 to be tested emits light when activated by the driver 21 of an emission signal generator for generating an emission signal. The light is condensed by the imaging lens 23 having an optical filter 26 with the characteristics of the dashed line D illustrated in FIG. 6 to transmit the main emission band but cut the sub emission band according to the emission, and to illuminate the optical sensor 24. The signal processing circuit 27 performs signal processing of a signal supplied through the A/D converter 25. A memory is provided as a storage medium used for the signal processing and stores data through the filter 26 and data without the filter 26 to be subjected to the signal processing.

In FIG. 9, the filter 26 for cutting the sub emission band is moved into and out of the optical path to obtain an output a with the filter 26 and an output b without the filter 26, and the outputs a and b are compared with each other to derive appropriate light amount correction data by an operation. Supposing the degrees of influence on the LED printer are the main emission band: the sub emission band=8:2, as in the fourth embodiment, it becomes feasible to enhance the accuracy of calculation of correction amount by employing values proportional to the following as the light amount data:

$$0.8\times\text{output a}+0.2\times(\text{output b}-\text{output a}).$$

For example, suppose the output a with presence of the filter 26 was 1 V and the output b was 1.2 V with one light emitting device. By substituting them into the above equation, $0.8\times1+0.2\times(1.2-1)=0.76$. If the other light emitting devices demonstrate agreement with the values corresponding to this 0.76 (the range of which is preliminarily determined by provision of thresholds), it is judged that the other light emitting devices have aligned accuracy for calculation of correction amount and thus the LED array can be supplied as one desired by the user. It can also be mentioned that the LED printer head and LED printer using the LED array according to this property are able to reproduce the image with high quality and with good accuracy.

As described above, it became feasible to realize the LED printer head and the LED printer adequately ready for pictorial images while enabling the accurate light amount correction and ranking of chips, by separately measuring and evaluating the main emission band and the sub emission band by use of the optical element for separating the main emission band from the sub emission band of the LEDs, performing the operation according to the degrees of influence on the printer, and handling the data as light amount data.

Figure 12:
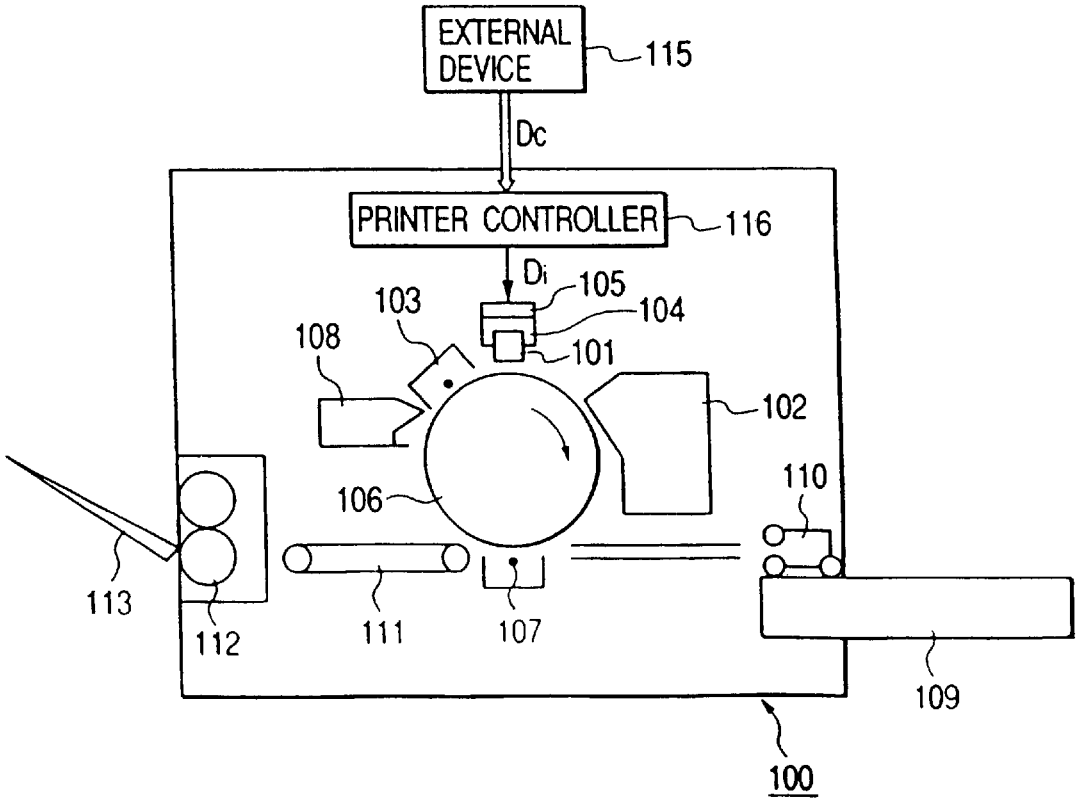
FIG. 12 is a diagram to show an LED printer according to the present invention.

FIG. 12 is a schematic, cross-sectional view to show a configuration example of an optical printer using the rod lens array of the present invention. This example is an example of a light emitting diode (LED) printer.

This printer main body 100 accepts input of code data Dc from an external device 115 such as a personal computer or the like. This code data Dc is converted into image data (dot data) Di by a printer controller 116 in the apparatus. This image data Di is supplied into a printer head 104 having the structure described in either of Embodiments 1 to 5. Then this light emitting diode (LED) array 105 emits an emission pattern modulated according to the image data Di and a photosensitive surface of photosensitive drum 106 as an information medium is scanned in the main scanning direction by this emission pattern.

In FIG. 12, the photosensitive drum 106 rotating clockwise is housed inside the printer main body 100. Above the photosensitive drum 106 as an information medium, there is provided the light emitting diode (LED) printer head 104 for exposure of the photosensitive drum. The LED printer head 104 is comprised of the light emitting diode (LED) array 105 in which a plurality of light emitting diodes to emit light according to the image signal are arrayed, and the rod lens array 101 for imaging the emission pattern of the light emitting diodes on the photosensitive drum 106. Here the rod lens array 101 has the structure described previously in any one of Embodiments 1 to 5. The members are placed so that the image plane of the light emitting diodes by the rod lens array 101 is matched with the position of the photosensitive drum 106. Namely, the radiative surface of the light emitting diodes and the photosensitive surface of the photosensitive drum are kept in the optically conjugate relation with each other by the rod lens array.

Around the photosensitive drum 106 as an information medium, there are provided a charging unit 103 for uniformly charging the surface of the photosensitive drum 106 and a developing unit 102 for forming a toner image by attaching toner to the photosensitive drum 106 according to the exposure pattern by the printer head 104. The apparatus is further provided with a transfer charger 107 for transferring the toner image formed on the photosensitive drum 106, onto an unrepresented transfer sheet such as a copy sheet or the like, and a cleaning means 108 for collecting toner remaining on the photosensitive drum 106 after the transfer, around the photosensitive drum 106.

Further, the printer main body 100 is provided with a sheet cassette 109 carrying transfer sheets, a sheet supplying unit 110 for supplying the transfer sheets in the sheet cassette 109 one by one to between the photosensitive drum 106 and the transfer charger 107, a fixing unit 112 for fixing the transferred toner image on the transfer sheet, a sheet conveying unit 111 for guiding the transfer sheet to the fixing unit 112, and a sheet discharge tray 113 for retaining the transfer sheet discharged after the fixing.

The procedures of image formation in the above LED printer will be described below.

First, the photosensitive drum 106 is preliminarily uniformly charged by the charging unit 103. On the other hand, in the printer head 104 the light emitting diodes of the LED array 105 are selectively activated to emit light according to the image information supplied from the unrepresented image information modulating means. This emission pattern of the LED array 105 is focused on the photosensitive drum 106 by the rod lens array 101 to effect exposure according to the image information. After completion of this exposure, a potential-like, latent image according to the exposure pattern is formed on the photosensitive drum 106 uniformly precharged.

Then toner is attached to the potential-like, latent image formed on the photosensitive drum 106, by the developing unit 102 to visualize the exposure pattern. A transfer sheet is conveyed to near the photosensitive drum 106 in synchronism with rotation of the photosensitive drum 106, from the sheet cassette 109 by the supplying means 110. When the transfer sheet passes between the photosensitive drum 106 and the transfer charger 107, the transfer charger 107 transfers the toner image formed on the photosensitive drum 106, onto the transfer sheet.

The transfer sheet with the toner image thus transferred is conveyed to the fixing unit 112 by the conveying means 111, where the toner is fixed on the transfer sheet. The transfer sheet with toner fixed is discharged onto the sheet discharge tray 113 the toner remaining on the photosensitive drum 106 after the transfer of the toner image onto the transfer sheet is removed by the cleaning means 108. In the LED printer of this example, the image formation is carried out by repeatedly carrying out such sequential process.

What is claimed is:

1. An LED head comprising an LED array of LEDs which emit light according to an image signal and which are arrayed at a resolution pitch P of not less than 600 dpi, and a multi-lens array for forming an emission image of said LED array on an information medium, wherein each of said LEDs of the LED array has a main emission band being an emission spectrum for formation of a main image and a sub emission band apart from a peak wavelength of the emission spectrum of the main emission band, and wherein a difference D between best total conjugate lengths at peak wavelengths of the emission spectrum of the main emission band and an emission spectrum of the sub emission band by said multi-lens array is at least 0.15 mm, and optical adjustment of said LED array and said multi-lens array is implemented so that light of the main emission band is focused in a predetermined imaging relation on a predetermined information medium.

2. The LED head according to claim 1, wherein said information medium is a photosensitive body, the peak wavelength of said main emission band and the peak wavelength of said sub emission band are 50 nm or more apart from each other, and a photosensitive intensity ratio R of the sub emission band to the main emission band in said photosensitive body is not less than 0.01.

3. The LED head according to claim 2, wherein an imaging element satisfying the following relation is used:

$$(2PF/D)^2*R<0.01,$$

where F is an equivalent F-number of said multi-lens array.

4. The LED head according to claim 2, wherein said LED array is AlGaAs-base LED chips.

5. The LED head according to claim 2, wherein said main emission band has a peak in the range of 700 nm to 800 nm and said sub emission band has a peak in the range of 850 nm to 900 nm.

6. The LED head according to claim 1, wherein said multi-lens array is an array of two lines of graded index type glass rod lenses with a nominal angular aperture of 20° and a nominal rod size of 0.6 mm in trefoil formation.

7. An image forming apparatus comprising the LED array as set forth in claim 6, wherein the information medium is a photosensitive body, said image forming apparatus comprising a developing unit for attaching toner to the photosensitive body to form a toner image thereon, a transfer charger for transferring the toner image formed on the photosensitive body, onto a transfer medium, and a fixing unit for fixing the transferred toner image on the transfer medium.

8. An image forming apparatus comprising the LED array as set forth in claim 6, wherein the information medium is a photosensitive body, said image forming apparatus comprising a printer controller for converting code data supplied from an external device, into an image signal and supplying the image signal to said LED array.

9. A method of measuring an amount of light from an LED array, wherein there are provided an LED array of LEDs for an LED head and a sensor portion for receiving an amount of light emitted from an activated LED and generating an electric output corresponding to the amount of light received, wherein the LED array of a measured object has a main emission band being an emission spectrum for formation of an image and a sub emission band being another emission spectrum apart from a peak wavelength of the emission spectrum of the main emission band, wherein spectral sensitivity of the sensor portion has approximately flat characteristics for the main emission band and the sub emission band, wherein an optical element for guiding the light amount of the main emission band with higher efficiency than the light amount of the sub emission band in accordance with sensitivity characteristics of a photosensitive body used with the LEDs is placed between the LED array and the sensor portion and emission characteristics of the LED array are measured.

10. The method according to claim 9, wherein the LED array has the main emission band of the emission spectrum for formation of the image and the sub emission band of another emission spectrum 50 nm or more apart from the peak wavelength of the main emission spectrum and a peak light amount of said sub emission band is 3% or more of a peak light amount of the main emission band.

11. An LED head wherein ranking or correction for light amount is effected according to data of measurement of light-amount unevenness of the LED array measured by the method as set forth in claim 9.

12. A method of measuring an amount of light from an LED array, wherein there are provided an LED array of LEDs for an LED head and two sensor portions for receiving an amount of light emitted from an activated LED and generating an electric output corresponding to the amount of light received, wherein the LED array of a measured object has a main emission band being an emission spectrum for formation of an image and a sub emission band being another emission spectrum apart from a peak wavelength of the emission spectrum of the main emission band, wherein spectral sensitivity of the sensor portions has approximately flat characteristics for the main emission band and the sub emission band, wherein an optical element for reflecting or transmitting a light amount of the main emission band and for transmitting or reflecting a light amount of the sub emission band is placed between the LED array and the two sensor portions, wherein the light amount of the main emission band is measured by one sensor portion out of the two sensor portions and the light amount of the sub emission band by the other sensor portion, a predetermined operation is carried out over measurement data of the light amount of the main emission band and measurement data of the light amount of the sub emission band to obtain single light-amount measurement data, and emission characteristics of the LED array are measured.

13. The method according to claim 12, wherein the LED array has the main emission band of the emission spectrum for formation of the image and the sub emission band of another emission spectrum 50 nm or more apart from the peak wavelength of the main emission spectrum and a peak light amount of said sub emission band is 3% or more of a peak light amount of the main emission band.

14. The method according to claim 12, wherein said predetermined operation is an operation to determine a rate of influence from the main emission band and from the sub emission band according to the sensitivity characteristics of a photosensitive body on which an image is formed according to amounts of light emitted from said LED array and to combine measurement data of the light amount of the main emission band and the light amount of the sub emission band.

15. An LED head wherein ranking or correction for light amount is effected according to data of measurement of light-amount unevenness of the LED array measured by the method as set forth in claim 12.

16. A method of measuring an amount of light from an LED array, wherein there are provided an LED array of LEDs for an LED head and a sensor portion for receiving an amount of light emitted from an activated LED and generating an electric output corresponding to the amount of light received, wherein the LED array of a measured object has a main emission band being an emission spectrum for formation of an image and a sub emission band being another emission spectrum apart from a peak wavelength of the emission spectrum of the main emission band, wherein spectral sensitivity of the sensor portion has approximately flat characteristics for the main emission band and the sub emission band, wherein an optical element for cutting either a light amount of the sub emission band or a light amount of the main emission band is placed in a retractable state between the LED array and the sensor portion, a predetermined operation is carried out over two output signal values obtained from two states of presence and absence of the optical element from the sensor portion, and emission characteristics of the LED array are measured.

17. The method according to claim 16, wherein the LED array has the main emission band of the emission spectrum for formation of an image and the sub emission band of another emission spectrum 50 nm or more apart from the peak wavelength of the main emission spectrum and a peak light amount of the sub emission band is 3% more of a peak light amount of the main emission band.

18. The method according to claim 16, wherein the predetermined operation is an operation to determine a rate of influence from the main emission band and from the sub emission band according to the sensitivity characteristics of a photosensitive body on which an image is formed according to amounts of light emitted from said LED array and to combine measurement data of the light amount of the main emission band and the light amount of the sub emission band.

19. An LED head wherein ranking or correction for light amount is effected according to data of measurement of light-amount unevenness of the LED array measured by the method as set forth in claim 16.

20. The method according to any one of claims 9, 12, and 16, wherein the LED array is AlGaAs-base LED chips.

21. The method according to any one of claims 9, 12, and 16, wherein the main emission band has a peak in the range of 600 nm to 800 nm and the sub emission band has a peak in the range of 850 nm to 900 nm.

22. The method according to any one of claims 9 and 16, wherein the sensor portion with the flat characteristics is a silicon PIN photodiode.

23. The method according to any one of claims 9, 12, and 16, wherein the optical element is a dichroic filter or mirror formed by stacking dielectric films and a medial wavelength of the dichroic filter or mirror is set between the peak wavelength of the main emission band and the peak wavelength of the sub emission band.

24. The method according to claim 9, wherein the optical element is an absorbing filter having a higher absorption property of the sub emission band than that of the main emission band and a rate of transmittance of the main emission band and transmittance of the sub emission band is approximately equal to a rate of influence on the photosensitive body on which an image is formed according to amounts of light emitted from the LED array, from the light amount of the main emission band and from the light amount of the sub emission band.

25. The method according to claim 24, wherein the absorbing filter is a heat absorbing filter with different absorptances in the main emission band and in the sub emission band and a rate of transmittance of the main emission band and transmittance of the sub emission band is optimized by controlling a thickness of the heat absorbing filter.

26. An image forming apparatus comprising the LED head as set forth in either claim 15 or 19, a photosensitive body, a developing unit for attaching toner onto the photosensitive body to form a toner image thereon, a transfer charger for transferring the toner image formed on the photosensitive body, onto a transfer medium, and a fixing unit for fixing the transferred toner image on the transfer medium.

27. An image forming apparatus comprising the LED head as set forth in any one of claims 11, 15, and 19, and a controller for converting code data supplied from an external device, into an image signal and supplying the image signal to the LED array.

28. An image forming apparatus comprising the LED array as set forth in any one of claims 1 to 5, wherein the information medium is a photosensitive body, said image forming apparatus comprising a developing unit for attaching toner to the photosensitive body to form a toner image thereon, a transfer charger for transferring the toner image formed on the photosensitive body, onto a transfer medium, and a fixing unit for fixing, the transferred toner image on the transfer medium.

29. An image forming apparatus comprising the LED array as set forth in any one of claims 1 to 5, wherein the information medium is a photosensitive body, said image forming apparatus comprising a printer controller for converting code data supplied from an external device, into an image signal and supplying the image signal to said LED array.

30. An image forming apparatus comprising the LED head as set forth in claim 11, a photosensitive body, a developing unit for attaching toner onto the photosensitive body to form a toner image thereon, a transfer charger for transferring the toner image formed on the photosensitive body, onto a transfer medium, and a fixing unit for fixing the transferred toner image on the transfer medium.

31. The method according to claim 12, wherein the sensor portions with the flat characteristics are silicon PIN photodiodes.

* * * * *

UNITED STATES PATENT AND TRADEMARK OFFICE

CERTIFICATE OF CORRECTION

PATENT NO. : 6,473,106 B2
DATED : October 29, 2002
INVENTOR(S) : Motomu Fukasawa It is certified that error appears in the above-identified patent and that said Letters Patent is hereby corrected as shown below:

Column 9,
Line 10, “influence: the” should read -- influence the --.

Column 14,
Line 48, “tray 113 the” should read -- tray 113. The --.

Signed and Sealed this

Fourth Day of November, 2003

JAMES E. ROGAN
*Director of the United States Patent and Trademark Office*